United States Patent [19]

Forsberg

[11] 4,086,782

[45] May 2, 1978

[54] NOISE REDUCTION ARRANGEMENT FOR A COMPRESSOR TYPE REFRIGERATOR

[75] Inventor: Per Erik Vilhelm Forsberg, Bandhagen, Sweden

[73] Assignee: Aktiebolaget Electrolux, Stockholm, Sweden

[21] Appl. No.: 737,709

[22] Filed: Nov. 1, 1976

Related U.S. Application Data

[63] Continuation-in-part of Ser. No. 568,701, Apr. 16, 1975, abandoned.

[51] Int. Cl.[2] ..... F25D 19/00; F25B 39/02; F25B 41/06

[52] U.S. Cl. ..... 62/296; 62/504; 62/511; 62/515

[58] Field of Search ..... 62/295, 296, 504, 515

[56] References Cited

U.S. PATENT DOCUMENTS

| | | | |
|---|---|---|---|
| 2,434,118 | 1/1948 | Newman | 62/511 |
| 2,590,731 | 3/1952 | Shawhan | 62/296 |
| 2,742,767 | 4/1956 | Alsing | 62/295 |
| 2,885,866 | 5/1959 | Kleist et al. | 62/515 |
| 3,531,947 | 10/1970 | Drury et al. | 62/511 |

FOREIGN PATENT DOCUMENTS

| | | | |
|---|---|---|---|
| 2,121,902 | 3/1973 | Germany | 62/504 |

*Primary Examiner*—Lloyd L. King
*Attorney, Agent, or Firm*—Alfred E. Miller

[57] ABSTRACT

A construction in a compressor-type refrigerator which is arranged between the condenser and the evaporator and adjacent to where a flow restricting tube connects to the evaporator tube whereby the noise level is considerably reduced when the refrigerant flows into the evaporator tube.

3 Claims, 7 Drawing Figures

NOISE REDUCTION ARRANGEMENT FOR A COMPRESSOR TYPE REFRIGERATOR

The present application is a continuation-in-part application of co-pending U.S. Patent application Ser. No. 568,701, filed Apr. 16, 1975, and now abandoned.

DESCRIPTION OF THE PRIOR ART

It is known to construct a compressor-type refrigerator having a horizontal evaporator connected to the capillary tube of a refrigerating apparatus. However, in certain constructions of this type an annoying sound is generated when the refrigerant flows through the evaporator. An arrangement for solving this problem is set forth in U.S. Pat. No. 3,531,947. This arrangement constitutes at least three consecutive tubular parts which are connected together and whose diameters increase successively in the flow direction and whose lengths decrease according to a particular mathematical formula. In pratice, however, this solution to the problem at hand has proved to be unsatisfactory since the reduction of the noise level is not substantial.

BACKGROUND OF THE INVENTION

The present invention relates to a refrigerating apparatus operated by a compressor and including a condenser, an evaporator having a tubular inlet, and a tubular conduit with a flow restriction device such as a capillary tube to control the flow of refrigerant from the condenser to the evaporator whereby the desired pressure difference between the condenser and evaporator is maintained.

It is an object of the present invention to provide a relatively simple construction in a refrigerating apparatus of the compressor type to achieve considerable sound damping in the evaporator part of the apparatus.

The invention will now be more fully described with reference to the accompanying drawings, in which.

DESCRIPTION OF THE PREFERRED EMBODIMENTS

Figure 1:
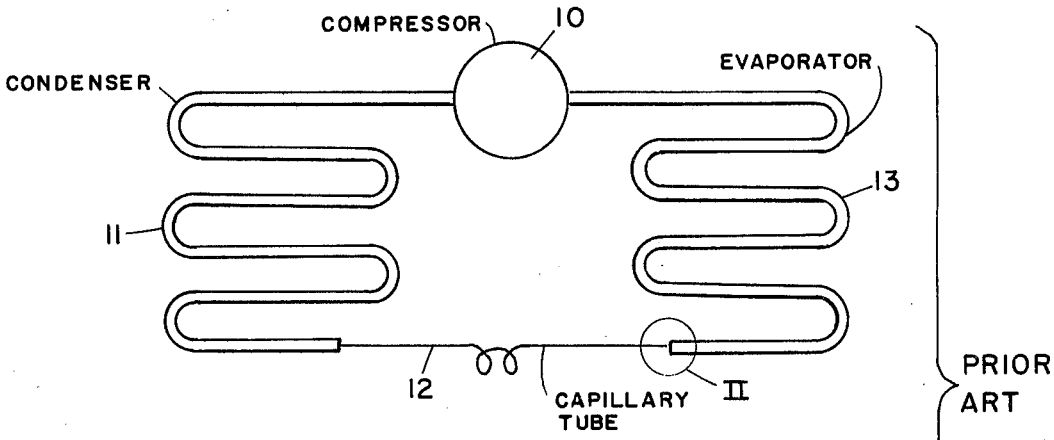
FIG. 1 is a diagrammatic view of the essential components of a compressor-type refrigerator constituting the prior art.
Figure 2:
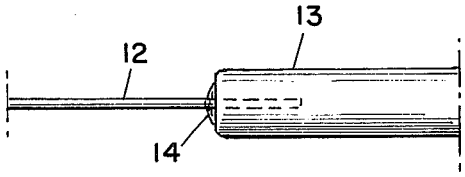
FIG. 2 PRIOR ART
FIG. 2 is an enlarged detail of the encircled part II of FIG. 1.

FIGS. 1 and 2 show a prior art construction comprising a compressor 10, a condenser 11, a capillary tube 12 and an evaporator 13 in a closed system. This system is well known in which the compressor 10 withdraws refrigerant of a known type from the evaporator 13 and discharges vapor under pressure into the condenser 11. The refrigerant is then condensed in the condenser, which is cooled in a known manner, and flows through a capillary tube 12. It should be evident that the flow resistance in the capillary tube is so great that a low pressure is maintained in the evaporator 13. It is usually the construction, as seen in FIG. 2, to insert the end of the capillary tube 12 a distance into the evaporator pipe 13 to which it is rigidly connected, as well as sealed by means of solder 14.

In most refrigeration apparatus there is a certain quantity of liquid refrigerant in the evaporator that is successively evaporated during the generation of cold. It has been found that if this liquid refrigerant is allowed to accumulate in the inlet part of the evaporator, the condensate in the evaporator affects unfavorably the further injection of condensate from the condenser and interferes with the accumulated liquid refrigerant. It should be noted that the noise to be eliminated or substantially reduced by the construction of the invention is created by the refrigerant flowing into the evaporator 13 from the capillary tube 12 at a great velocity.

Figure 4:
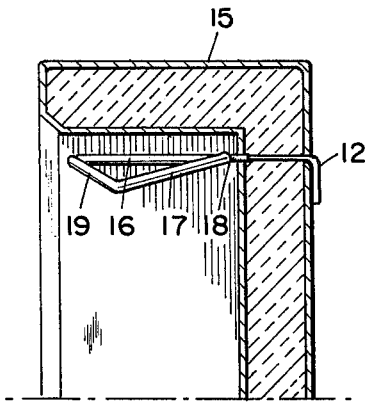
FIG. 4 is a cross-sectional view taken along the lines IV—IV of FIG. 3 showing the construction and arrangement of the present invention.
Figure 3:
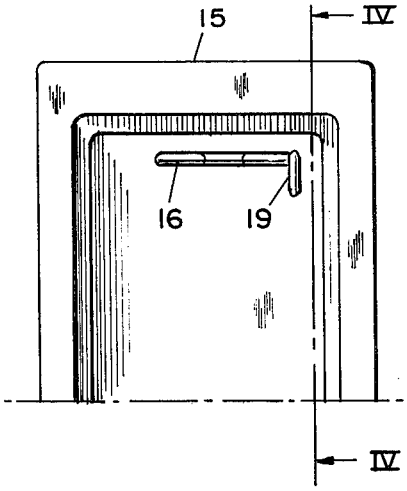
FIG. 3 is an elevational view of a compressor-type refrigerator with the door removed for purposes of clarity, and embodying the teachings of the present invention.

Referring now to FIGS. 3 and 4 in which the apparatus constructed in accordance with the present invention is shown, a refrigerator 15 is illustrated which is provided with an evaporator 16 connected to the capillary tube 12 and extends substantially in a horizontal plane. The evaporator 16 has a part 17 which is connected to an end of the capillary tube 12 at a point 18 with a part of said tube 12 projecting within the part 17. The part 17 is inclined in a downward direction from the point 18. The angle of inclination of part 17 is from 1° to approximately 15°, in order to make the apparatus of practical value. The other downward end of the inlet part is connected to an upwardly inclined part 19 relative to the horizontal parts of the evaporator 16. The foregoing construction results in a considerable damping of the sound in the evaporator portion of the refrigeration apparatus.

Figure 5:
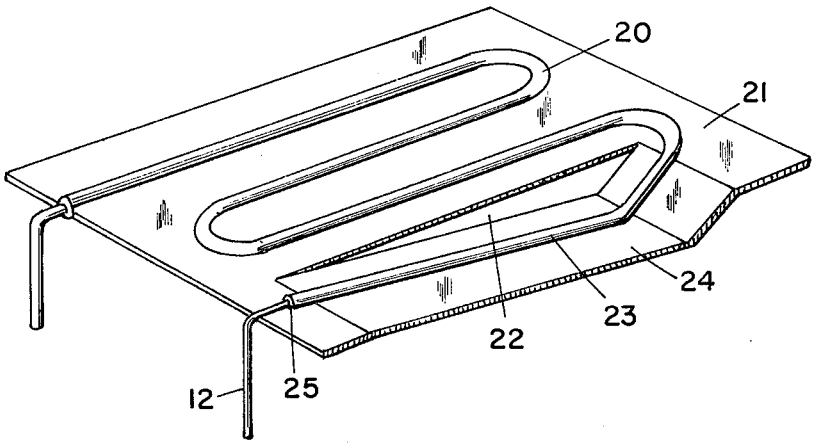
FIG. 5 is a perspective view of an alternative embodiment of the present invention.

FIG. 5 shows a further embodiment of the present invention in which a rollbond evaporator 20 is shown which comprises metal plates that are joined to form an evaporator plate 21. A slot 22 is shown cut through the plate 21 which separates the evaporator inlet part 23, positioned on the plate strip 24 from the remainder of the evaporator. Furthermore, the strip 24 is bent downwardly from the connection point 25 of the capillary tube 12 to the inlet part 23.

Figure 7:
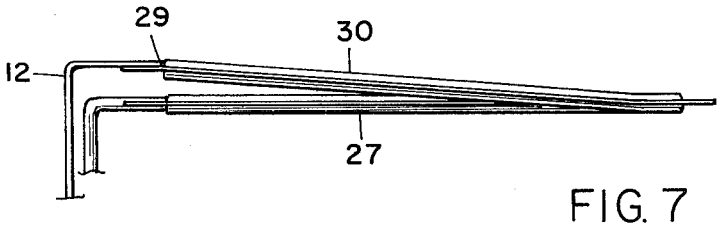
FIG. 7 is a side elevational view of the structure shown in FIG. 6.
Figure 6:
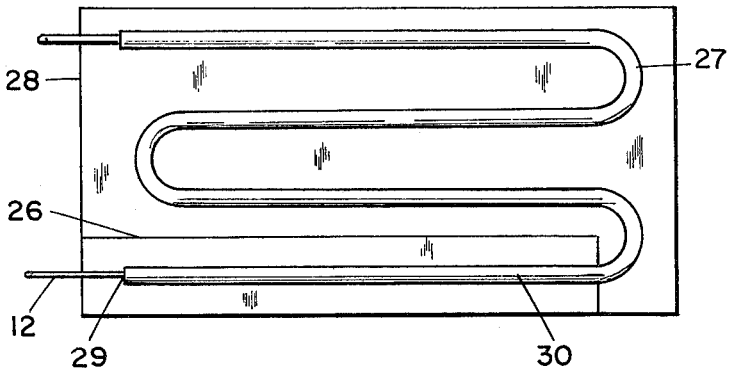
FIG. 6 is a top plan view of a modification of the present invention.

Instead of utilizing the construction shown in FIG. 5, and if there is sufficient room in the refrigerator, a slot 26 can be provided in the evaporator plate which extends to the edge 28 of the evaporator 27. The connection point 29 of the capillary tube 12, as seen in FIG. 7, is positioned above the horizontal plane of the evaporator 27.

Furthermore, if there is sufficient room in the refrigerator in the construction shown in FIGS. 3 and 4, the connection point 18 can be arranged on a higher plane than the location of the horizontal evaporator 16 so that the evaporator part 30 is located adjacent to the connection point and inclines in a downwardly direction from that point.

What is claimed is:

1. In a refrigerating apparatus operated by a compressor and including a condenser, an evaporator having a generally horizontally disposed evaporator part and a flow restricting device for controlling the flow of refrigerant from the condenser to the evaporator in order to maintain the desired pressure difference between the condenser and evaporator, said flow restricting device being a substantially horizontally disposed capillary tube connecting said condenser to said evaporator part, the improvement comprising: said evaporator part having a conduit part that slopes downwardly with its inlet end inclined and the capillary tube has a free end that projects into said inlet end of the conduit part of said evaporator part, the slope angle of said conduit part being chosen from 1° to about 15° so that the noise resulting from the flow of refrigerant at considerable velocity from said free end of said capillary tube to the adjacent evaporator part is substantially dampened.

2. The arrangement as claimed in claim 1 wherein the inclination of said evaporator conduit part from said connection point is caused by said evaporator conduit part being bent downwardly and below the plane of a substantial part of the remainder of said evaporator.

3. In a refrigerating apparatus operated by a compressor and including a condenser, an evaporator having a horizontally disposed evaporator part and a flow restricting device for controlling the flow of refrigerant from the condenser to the evaporator in order to maintain the desired pressure difference between the condenser and evaporator, said flow restricting device being a capillary tube connecting said condenser to said evaporator part, the improvement comprising: said evaporator part having a conduit part that slopes downwardly with its inlet end inclined and the capillary tube has a free end that projects into said inlet end of the conduit part of said evaporator part, the slope angle of said conduit part being chosen from 1° to about 15° so that the noise resulting from the flow of refrigerant at considerable velocity from said free end of said capillary tube to the adjacent evaporator part is substantially dampened, and said evaporator including a conduit secured to a plate and further comprising a slot in said plate separating said evaporator conduit part from the remainder of said evaporator.

* * * * *